United States Patent [19]

Tsao et al.

[11] Patent Number: 4,903,033

[45] Date of Patent: Feb. 20, 1990

[54] PLANAR DUAL POLARIZATION ANTENNA

[75] Inventors: Chich-Hsing Tsao, Saratoga; Yeongming Hwang, Los Altos Hills; Francis J. Kilburg, Mountain View; Fred J. Dietrich, Palo Alto, all of Calif.

[73] Assignee: Ford Aerospace Corporation, Newport Beach, Calif.

[21] Appl. No.: 176,581

[22] Filed: Apr. 1, 1988

[51] Int. Cl.[4] ..... H01Q 1/38

[52] U.S. Cl. ..... 343/700 MS; 343/829

[58] Field of Search ..... 343/700 MS, 829, 846, 343/830

[56] References Cited

U.S. PATENT DOCUMENTS

| | | | |
|---|---|---|---|
| 3,854,140 | 12/1974 | Ranghelli et al. | 343/814 |
| 4,054,874 | 10/1977 | Oltman | 343/700 MS |
| 4,170,013 | 10/1979 | Black | 343/700 MS |
| 4,329,689 | 5/1982 | Yee | 343/700 MS |
| 4,364,050 | 12/1982 | Lopez | 343/700 MS |
| 4,529,987 | 7/1985 | Bhartia et al. | 343/700 MS |
| 4,554,549 | 11/1985 | Fassett et al. | 343/700 MS |
| 4,710,775 | 12/1987 | Coe | 343/767 |
| 4,719,470 | 1/1988 | Munson | 343/700 MS |
| 4,761,654 | 8/1988 | Zaghloul | 343/700 MS |

FOREIGN PATENT DOCUMENTS

| | | | |
|---|---|---|---|
| 160103 | 12/1981 | Japan . | |
| 62-165403 | 7/1987 | Japan . | |
| 1298820 | 3/1987 | U.S.S.R. . | |
| 2166907A | 9/1985 | United Kingdom | 343/700 MS |

OTHER PUBLICATIONS

Pozar, D. M., "Microstrip Antenna Aperture-Coupled to a Microstripline", *Electronic Letters*, vol. 21, pp. 49-50, Jan. 1985.

I-Ping Yu, "Multiband Microstrip Antenna", *NASA Tech. Briefs*, Spring 1980, Johnson Space Center, Houston, Tex.

Sabban, A., "A New Broadband Stacked Two-Layer Microstrip Antenna", IEEE AP-S International Symposium, Houston, Tex., *Digest*, May 23-26, 1983.

Chen et al., "Broadband Two-Layer Microstrip Antenna", *Digest*, 1981, IEEE AP-S International Symposium.

James et al., *Microstrip Antenna Theory and Design*, IEE, 1981, Peter Peregrinus Ltd.

*Primary Examiner*—Rolf Hille
*Assistant Examiner*—Michael C. Wimer
*Attorney, Agent, or Firm*—Edwrad Radlo; Edward J. Radlo; Keith L. Zerschling

[57] ABSTRACT

A microwave-frequency microstrip antenna (10) simultaneously usable for both transmitting and receiving microwave-frequency signals that have dual orthogonally polarized components. The components may be either linearly or circularly polarized. A radiating patch (26) is mounted on a first dielectric (12). A ground plane (20) abuts the first dielectric (12) and has two elongated coupling apertures (32,31) at right angles to each other. A second dielectric (22) abuts the ground plane (20) and has embedded thereon two substantially identical conductive planar feed networks (52,51) that are disposed at right angles to each other. At least one additional optional dielectric layer (16,18) having a conductive patch (36,34) may be interposed between the first dielectric (12) and the ground plane (20) for purposes of broadening the bandwidth of the antenna (10). A meanderline polarizer (45) or a 3 dB 90° hybrid coupler (40) may be used for converting from linear polarization to circular polarization.

8 Claims, 2 Drawing Sheets

FIG. 1
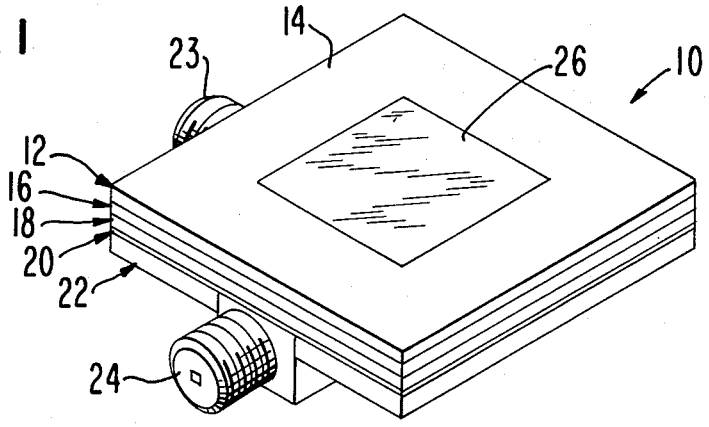
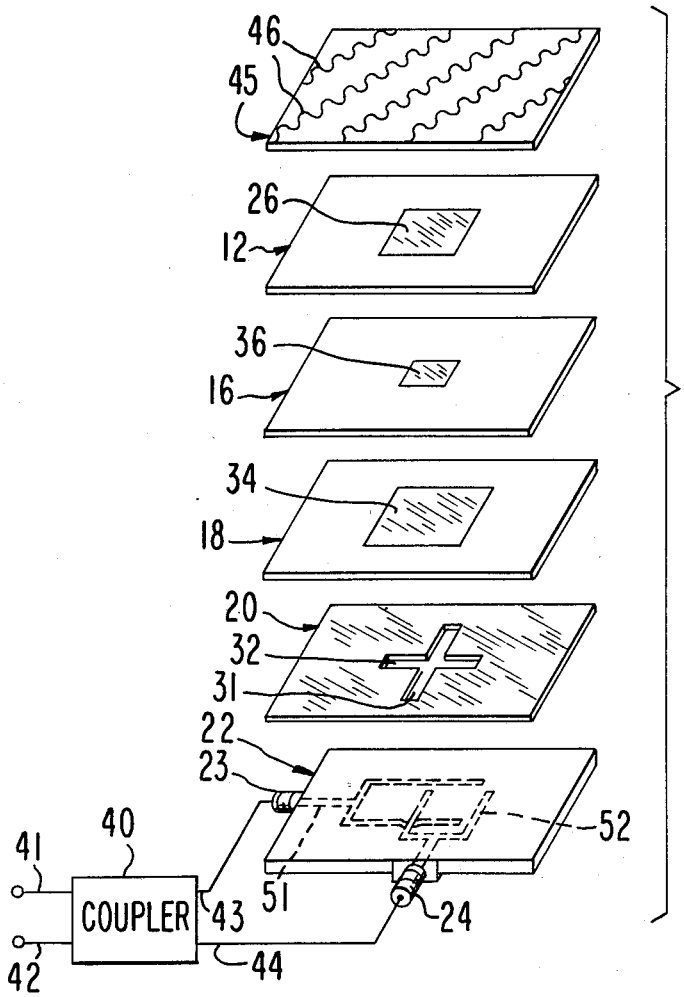
FIG. 2

PLANAR DUAL POLARIZATION ANTENNA

DESCRIPTION

Technical Field

The present invention relates to microstrip antenna structures and more specifically to a microstrip antenna capable of handling two orthogonally polarized signals simultaneously, while exhibiting wide bandwidth characteristics (2:1 VSWR bandwidth and 25 dB polarization isolation bandwidth greater than 20%).

The use of microstrip techniques to construct microwave antennas has recently emerged as a consequence of the need for increased miniaturization, decreased cost, and improved reliability. One primary application of high interest is in the construction of large phased array systems.

However, few microstrip antennas are designed to handle dual orthogonally polarized signals simultaneously, both for transmit and receive. Furthermore, microstrip antennas have heretofore suffered from relatively narrow operational bandwidth, which limits tunability of the devices. It is desirable to have an antenna having at least as great a bandwidth as the feed system. And it is in general desirable to have devices with as wide a bandwidth as possible for various wideband applications.

Background Art

The following references were uncovered in relation to the subject invention:

Lopez, U.S. Pat. No. 4,364,050, describes a dual polarization microstrip antenna wherein the radiating elements are cross-slots rather than conductive patches as in the present invention. The cross-slots are formed in a conducting sheet sandwiched between a vertical feed network and an orthogonal horizontal feed network. Interference may result in the radiation pattern because of blockage of radiation by the feed networks. In the present invention, the feed networks 52,51 for both polarizations lie substantially in a single plane 30. The feed networks 52, 51 do not block radiation leaving or entering the antenna 10. A ground plane 20 sandwiched between the feed circuitry 52,51 and a radiating patch 26 prevents radiation from the feed circuitry 52,51 from interfering with the desired radiation from patch 26.

The following additional references all disclose microstrip antennas, but none discloses dual polarization, which is an essential ingredient of the present invention:

U.S. patent application 156,259 filed Feb. 16, 1988, having the same inventors and same assignee as the instant application, discloses the use of conductive patches intermediate the radiating patch and the ground plane to improve bandwidth.

Pozar, "Microstrip Antenna Aperture-Coupled to a Microstripline," *Electronics Letters,* Vol. 21, pp. 49–50, Jan. 17, 1985, describes an aperture coupling technique for feeding a microstrip antenna. The reference does not disclose the present invention's use of multiple tuning patches situated intermediate a radiating patch and a ground plane to increase bandwidth.

Yee, U.S. Pat. No. 4,329,689, describes a microstrip antenna structure having stacked microstrip elements. However, the coupling is a direct, mechanical connection. A central conductor extends from a ground plane directly to an uppermost conducting plane which serves as a radiator. Because there is a central conductor extending through the multiple layers, the central conductor presents an inductance which contributes to detuning effects, an undesirable characteristic. Physical connection such as soldering is required to secure the feed electrically to the conducting plane. Couplings which rely on physical connection are subject to undesired mechanical failure. The aperture coupling feed scheme of the present invention eliminates soldering. Furthermore, in the reference, no provision is shown or suggested for continuous wideband operation as in the present invention.

Fassett, U.S. Pat. No. 4,554,549, describes a microstrip antenna in which a feedline and a radiating element, a ring, are on the same side of a ground plane. As a consequence, there is a possibility that undesired or stay radiation patterns may be generated from the feedline. The reference does not disclose bandwidth-broadening patches.

Black, U.S. Pat. No. 4,170,013, describes an antenna with a stripline feed. The stripline (sandwiched between two ground planes) is directly connected to a radiating patch. The radiating patch in turn radiates through an aperture. The aperture must be larger than the radiating patch. In the present invention, the radiating patch is larger than the coupling apertures. The reference does not disclose bandwidth-broadening patches.

Bhartia, U.S. Pat. No. 4,529,987, describes a microstrip antenna having a bandwidth broadening feature in the form of a pair of varactor diodes. Physical connection of the diodes is required to electrically couple between the radiator and the ground plane.

Yu, "Multiband Microstrip Antenna," *NASA Tech Briefs,* Spring 1980, MSC-18334, Johnson Space Center, describes a multiband, narrow bandwidth microstrip antenna having a direct physical connection between radiating elements and a pin feed attached to a coaxial connector. No provision is made for continuous wide-bandwidth operation.

Sabban, "A New Broadband Stacked Two-layer Microstrip Antenna," *Digest,* 1983 IEEE AP-S International Symposium, Houston, Tex., May 23–26, 1983, pp. 63–66, describes a microstrip antenna which employs a direct feed. The design is said to have a continuous 2:1 VSWR bandwidth of 9–15 percent. The feed network and the radiator are on the same side as the ground plane. Aperture coupling is not used.

Chen et al., "Broadband Two-layer Microstrip Antenna," *Digest,* 1981 IEEE AP-S International Symposium, pp. 251–254, describes another microstrip antenna with a direct feed. A probe, which is typically the center conductor of a coaxial cable, is connected as by soldering to a first patch near the ground plane. As such, the physical connection is subject to failure, and the probe presents an effective inductance which contributes to detuning effects. The feeder patch and radiating patch are on the same side as the ground plane. Aperture coupling is not used.

James et al., *Microstrip Antenna Theory and Design,* IEE, 1981: Peter Peregrinus Ltd., Chapter 10 (on trends and future developments) illustrates various schemes for a patch antenna. Of particular note is FIG. 10.18 on page 274, which shows radiation by a slot rather than a conductive patch.

United Kingdom patent application GB 2,166,907A describes another microstrip antenna in which there is a direct coupling to a radiating element. This is a fabrication technique for producing a pretuned conventional narrow bandwidth microstrip antenna. The device is tuned without significantly affecting bandwidth by painting coatings of a dielectric across the radiating surface. Multiple bandwidth-broadening patches are not disclosed.

What is needed, and what is provided by the instant invention, is a microstrip antenna having the capability of simultaneously handling duel orthogonal polarizations (both for transmit and receive), having a physically sturdy coupling, and which is capable of wideband operation.

Disclosure of the Invention

The invention is a microwave-frequency microstrip antenna (10) simultaneously usable with dual orthogonally polarized signals. The antenna (10) comprises a substantially planar 90° rotation-symmetric conductive radiating patch (26) mounted on a substantially planar first dielectric (12) having first and second sides. A substantially planar conductive ground plane (20) has a first side facing the second side of the first dielectric (12). The ground plane (20) has two elongated coupling apertures (32,31) having substantially the same size and shape, and being disposed at right angles to each other. A substantially planar second dielectric (22) has a first side facing a second side of the ground plane and a second side (30) on which lie two substantially identical conductive planar feed networks (52,51) that correspond to the first and second orthogonal polarizations. The feed networks (52,51) are disposed at right angles with respect to each other. Each feed network (52,51) is symmetric about a center plane which is orthogonal to the first and second dielectrics (12,22) and ground plane (20), and which bisects a corresponding one of the coupling apertures (32,31).

BRIEF DESCRIPTION OF THE DRAWINGS

These and other more detailed and specific objects and features of the present invention are more fully disclosed in the following specification, reference being had to the accompanying drawings, in which:

FIG. 1 is a perspective view of a preferred embodiment of microstrip antenna 10 in accordance with the present invention;

FIG. 2 is an exploded view of the embodiment of antenna 10 depicted in FIG. 1;

BEST MODE FOR CARRYING OUT THE INVENTION

Figure 3:
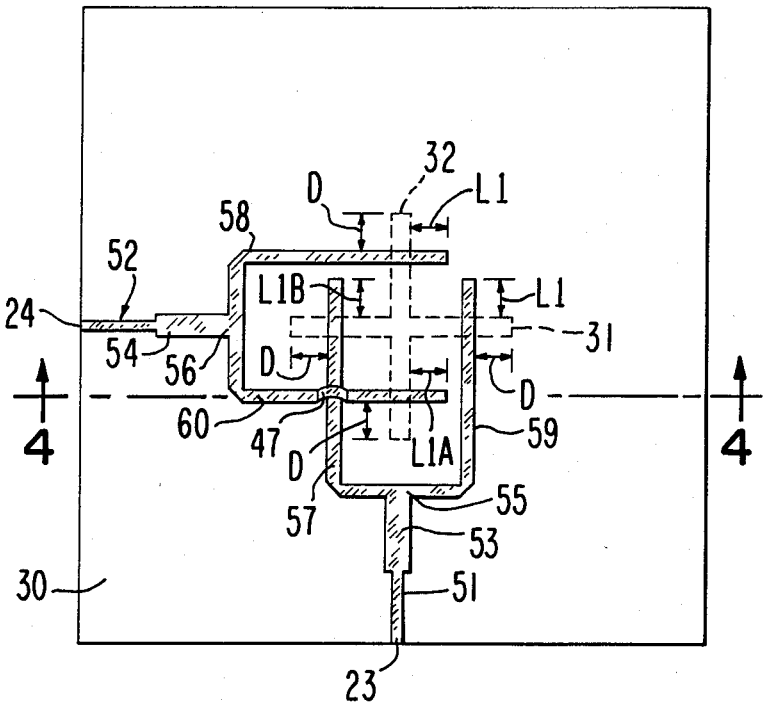
FIG. 3 is a bottom plan view of the embodiment depicted in FIG. 2.

Referring now to FIG. 1, there is shown a perspective view of a microstrip antenna 10 in accordance with the present invention. The antenna described herein is practical for application at microwave frequencies between about 1 GHz and 20 GHz. There is no theoretical frequency limit based on principle. Above about 20 GHz, however, microstrip antennas in general exhibit high losses. Below 1 GHz, wire antennas are more practical because of the large size of antenna needed.

Microstrip antenna 10 comprises several layers, selected ones of the layers contributing to the functions of feed, coupling, impedance matching, radiation, and bandwidth broadening. It is to be understood that the layers of the antenna 10 are generally planar.

As shown in FIG. 1, there is a radiating layer 12 having one side 14 exposed to free space, possibly one or more optional intermediate layers 16, 18 as hereinafter explained, a ground plane 20 of no particular thickness, and a feed layer 22. Mounted on one edge of the feed layer 22 is a feedline connector 24 connected to a feed network 52 (see FIG. 2). Mounted on an adjacent edge of layer 22 is a feedline connector 23 connected to a feed network 51, which is also illustrated in FIG. 2. Networks 52,51 correspond to dual orthogonal linear polarizations. It is to be appreciated that antenna 10 is usable for both transmit and receive. Feedline connectors 24,23 may be standard coaxial SMA-type connectors suited to the operating frequencies of interest.

Radiating layer 12 is fabricated of a dielectric material and has embedded thereon a substantially planar conductive radiating patch 26. Radiating patch 26 may have the shape of a square, circle, octagon, or any other shape which is "90° rotation-symmetric". By this is meant that if one rotates patch 26 by 90° in either direction in the plane of layer 12, one does not change the shape of patch 26 from the point of view of a stationary observer looking broadside onto patch 26. In the embodiment illustrated in the Figures, radiating patch 26 is square-shaped with no apertures therethrough. Radiating patch 26 is inductively coupled to feed networks 52,51, as hereinafter explained, for radiating microwave energy applied through feed networks 52,51; or reciprocally, for receiving microwave signals and coupling those signals to feed networks 52,51.

Referring to FIG. 2, there is shown an exploded view of the antenna 10 of FIG. 1. Feed layer 22 is fabricated of a dielectric material and has embedded on its bottom surface 30 two substantially identical planar feed networks 52,51 that are disposed at right angles with respect to each other. Feed networks 52,51 are in the form of strips of electrically conductive material attached to the center conductors of feedline connectors 24,23, respectively. The configuration shown in the Figures is a microstrip configuration in which only one ground plane 20 is used. Alternatively, a stripline configuration could be employed, in which a second ground plane is used, situated on the side of feed layer 22 opposite that of ground plane 20.

Feed layer 22, optional intermediate layers 16 and 18, and radiating layer 12 are constructed of dielectric material suited to operation in the environment of interest. Suitable dielectric is high-density foam or a standard dielectric material sold under the registered trademark RT/DUROID of Rogers Corporation, Rogers, Conn. RT/DUROID material is available with a dielectric constant in the range of about 2.2 to about 10.6. Other materials are also useful in accordance with the invention, so long as dielectric losses are minimized at the frequencies of interest and other mechanical criteria are satisfied. RT/DUROID is available with copper cladding on one or both sides. Feed layer 22 is advantageously constructed of double-cladded RT/DUROID material, wherein the bottom side 30 is etched to form feed networks 52,51; the cladding on the opposing side can become ground plane 20.

In accordance with the invention, coupling apertures 32,31 are provided in ground plane 20 as part of the electromagnetic coupling to radiating patch 26, as explained hereinafter in greater detail. Apertures 32,31 may be etched from the copper cladding forming ground plane 20.

One or more optional intermediate layers 16, 18 are used when one wishes to increase the continuous bandwidth, similarly as described in our aforesaid U.S. patent application Ser. No. 156,259 filed Feb. 16, 1988 now U.S. Pat. No. 4,847,625. Layers 16,18 and radiating layer 12 may be cladded on one side with a conductive layer. The cladded layers are then etched away to leave coupling patches 34, 36, 26 of conductive material, each in a 90° rotation-symmetric pattern of relatively small thickness. A typical thickness of a patch 34,36,26 is 25 microns, whereas a typical intermediate layer 18,16 thickness is 500 to 1000 microns.

When optional intermediate layers 18,16 are not used, radiating layer 12 is normally made to have a relatively large thickness, e.g., greater than 1000 microns, in an attempt to increase the bandwidth. However, a radiating layer 12 having a thickness which is of any significant percentage of the wavelengths of interest will inhibit effective aperture coupling and may well allow excitation of undesired surface waves. Therefore, one or more intermediate layers 18,16 should be used when layer 12 becomes too thick. Coupling patches 34, 36 are positioned between radiating patch 26 and apertures 32,31. Patches 34,36 provide the desired broadband tuning and capacitive energy coupling across the separation between radiating patch 26 and apertures 32,31.

The number and thickness of the intermediate layers 16, 18 are selected in accordance with design specifications respecting the desired bandwidth characteristics of antenna 10. Thus, the two intermediate layers 16,18 depicted in the Figures is an arbitrary number; there can be more than two such layers. The greater the separation imposed by substrates 18,16, the broader the operational bandwidth. However, at a frequency of about 20 GHz, it is recommended that the maximum separation between top and bottom conductive layers 26 and 20 not exceed about 1000 microns.

Intermediate layers of different dielectric materials might be employed to achieve variations in the dielectric characteristics in the axial direction. Dielectric materials might also be used, for example, to construct antennas 10 having integrated focussing elements. Layers of material (not shown) may also be applied over radiating patch 26 for protection or for matching with the impedance of free space.

If one wishes to use antenna 10 with circular polarization rather than linear polarization, two techniques are possible, both of which are illustrated in FIG. 2. The first technique is to place a meanderline polarizer 45 on top of radiating layer 12. Meanderline polarizer 45 consists of a planar dielectric layer, the top surface of which is embedded with conductive, generally parallel, wiggly meanderlines 46. Meanderlines 46 must be positioned so that they make substantially 45° angles with respect to each of the coupling apertures 32,31. In transmit mode, polarizer 45 converts dual linearly orthogonally polarized signals into dual orthogonally polarized lefthand and righthand circularly polarized (LHCP and RHCP) signals. In receive mode, polarizer 45 converts lefthand and righthand circularly polarized signals into dual linearly orthogonally polarized signals.

The second technique for using antenna 10 with circular polarization is to employ optional 3 dB 90° hybrid coupler 40. Such a coupler 40 has four ports, 41–44. Ports 43 and 44 are connected to the center conductors of feedline connectors 23,24, respectively. Signals applied to ports 41 and 42 are converted to signals at ports 43 and 44 which are propagated by antenna 10 as dual orthogonally circularly polarized signals.

Referring to FIG. 3, there is shown a bottom plan view of layer 22 of the embodiment of antenna 10 shown in FIG. 2. FIG. 3 shows the lateral alignment of feed networks 52,51 with their associated coupling apertures 32,31, respectively. For both linear and circular polarization, the long axes of elongated coupling apertures 32,31 are orthogonal to the direction of beam propagation. The preferred maximum aperture 32,31 length is less than one-half the wavelength at the nominal center frequency of intended operation.

FIG. 3 shows that each feed network 52,51 preferably comprises two elongated branches (58,60 and 57,59, respectively) of planar conductive material. Feed networks 52,51 are disposed at right angles to each other, have substantially the same size and shape, and are symmetric about a plane which is orthogonal to dielectric 22 and bisects the corresponding coupling aperture 32,31, respectively. This balanced geometry preserves isolation at the connection ports 24,23; minimizes the coupling between the apertures 32,31; and keeps the cross-polarized far-field radiation suppressed.

The conductive branches (58,60 and 57,59 respectively) are connected together via power combiners 56,55, respectively. Power combiners 56,55 can be of the reactive type, as illustrated in FIG. 3, or they can be of the Wilkinson type, in which case resistors (not illustrated) connect the branches (58, 60 and 57, 59, respectively). Between each power combiner 56,55 and its associated feedline connector 24,23, respectively, is a relatively wide impedence matching section 54,53, respectively.

Each coupling aperture 32,31 is seen to extend a distance D beyond the corresponding conductive branch 57–60. D is preferably approximately equal to one-fourth the length of each coupling aperture 32,31.

Figure 4:
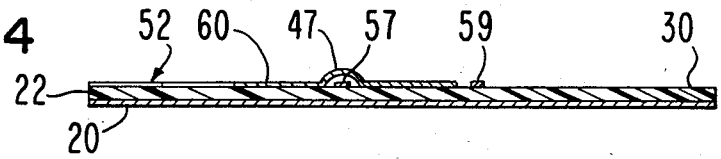
FIG. 4 is a side view of the embodiment shown in FIG. 3.

The distance that each conductive branch 57–60 extends beyond its corresponding coupling aperture 32,31 in a direction along the long axis of the branch 57–60 (nominally L1) and the width of branches 57–60 are selected for best impedance matching of antenna 10. L1 should be approximately equal to one-quarter of the wavelength at the operating frequency. This maximizes the current in the vicinity of the coupling apertures 32,31. The exact value of L1 depends upon the overall structure of antenna 10, for example, the thicknesses of the layers 12,16,18,20,22 and their dielectric constants. In practice, it is often desirable to slightly change the value of L1 for two of the branches 60,57. This is because an air bridge crossover 47 (see also FIG. 4) must be used to avoid an electrical connection between branches 60,57. Thus, branch 60 extends a distance of L1A beyond its corresponding coupling aperture 32 and branch 57 extends a distance of L1B beyond its corresponding coupling aperture 31.

Figure 5:
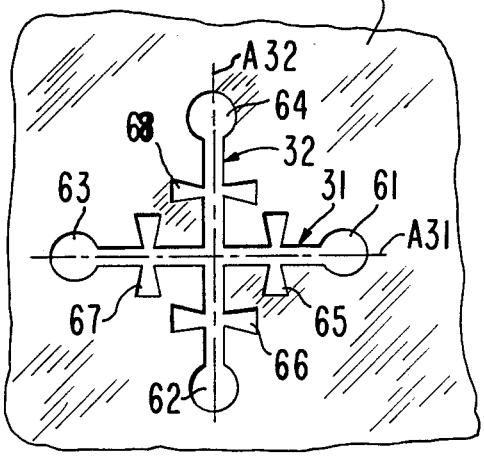
FIG. 5 is an alternate embodiment of coupling apertures 31,32.

FIG. 5 illustrates that loading (i.e., regions of relatively greater width) may be used in coupling apertures 32,31 to further improve the impedance matching and increase the bandwidth of antenna 10. FIG. 5 shows that aperture 32 uses end loads 64,62 and intermediate loads 68,66; while aperture 31 uses end loads 63,61 and intermediate loads 67,65. The loads can be of any shape and can be located at any point along the long axes A32,A31 of the apertures 32,31, as long as symmetry is preserved about both the long and short axis of each aperture 32,31. There can be more than one pair of loads on each aperture 32,31.

Figure 6:
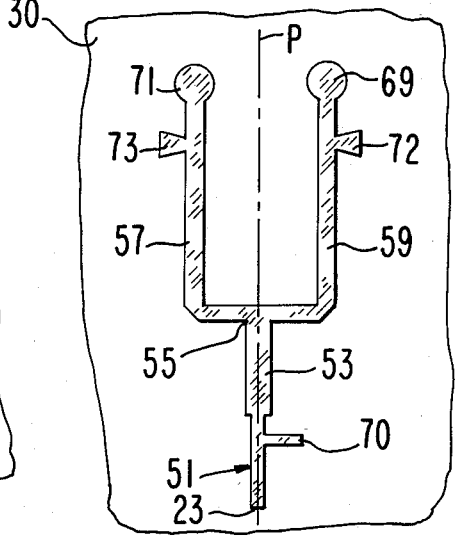
FIG. 6 is an alternate embodiment of microstrip feed network 51.

FIG. 6 shows that loads, i.e., regions of relatively greater width, can be used on the conductive microstrip feed networks 52,51, also to further improve the impedance matching and increase the bandwidth of antenna 10. The loads can be of any shape. If the loads are located between the power combiner 56,55 and the ends of the branches 57–60, they should be symmetric about center plane P of the feed network 52,51. This is shown in FIG. 6 for end loads 71,69 and intermediate loads 73,72 of network 51. If the load is situated between the power combiner 56,55 and the corresponding feed line connector 24,23, however, symmetry about plane P is not necessary. This is illustrated in FIG. 6 with respect to load 70.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. A microwave-frequency microstrip antenna simultaneously usable with dual orthogonally polarized signals, comprising:

a substantially planar 90° rotation-symmetric conductive radiating patch mounted on a substantially planar first dielectric having first and second sides;

a substantially planar conductive ground plane having a first side facing the second side of the first dielectric, said ground plane having two elongated coupling apertures having substantially the same size and shape, being disposed at right angles to each other, being less than one-half wavelength long at the nominal center frequency of operation, and crossing each other at their respective midpoints;

a substantially planar second dielectric having a first side facing a second side of the ground plane and a second side on which lie two substantially identical conductive planar feed networks that correspond to the dual orthogonal polarizations and are disposed at right angles with respect to each other, wherein each feed network is symmetric about one of two center planes, respectively, each of which is orthogonal to the first and second dielectrics and ground plane and which bisects a corresponding one of the coupling apertures; and at least one additional substantially planar tuning layer interposed between the first dielectric and the ground plane, wherein each tuning layer comprises a dielectric material on which lies a conductive non-apertured tuning element that is centered with respect to each feed network, whereby the bandwidth of the antenna is dependent upon the number, composition, and thickness of the tuning layers; wherein the projection of each aperture onto the plane of the radiating patch is centered with respect to the radiating patch;

each feed network comprises two elongated substantially identical parallel conductive microstrip elements positioned equidistant from their associated center plane, each microstrip element being disposed orthogonally with respect to its associated coupling aperture; and the antenna radiates in one direction only, said direction being defined by a vector originating at the midpoints of the coupling apertures and terminating at the midpoint of the radiating patch.

2. The antenna of claim 1 wherein each coupling aperture is symmetric about a long axis that is orthogonal to the center plane of the corresponding feed network.

3. The antenna of claim 1 further comprising a substantially planar third dielectric having first and second sides, said second side of said third dielectric facing the first side of said first dielectric; wherein:

the first side of said third dielectric has embedded thereon a meanderline polarizer comprising generally parallel wiggly conductive elements that are oriented at substantially a 45° angle with respect to each of the two coupling apertures.

4. The antenna of claim 1 further comprising a 3 dB 90° hybrid coupler having four ports, two of which are respectively coupled to the two feed networks.

5. The antenna of claim 1 wherein each coupling aperture has loaded regions where the aperture has been widened with respect to an aperture not so loaded, and each aperture is symmetric about each of the two center planes.

6. The antenna of claim 1 wherein each conductive microstrip element has at least one loaded region that is relatively wide compared with a conductive microstrip element that is not so loaded; and symmetry of each feed network about its corresponding center plane is preserved despite the presence of the loaded region(s).

7. The antenna of claim 1 wherein the length of each aperture is less than one-half the wavelength at the nominal center frequency of operation;

the distance that the projection of each aperture extends beyond each of its corresponding two conductive microstrip elements is approximately one-fourth the length of said aperture; and the distance that the projection of each conductive microstrip element extends beyond its associated aperture is approximately one-quarter of a wavelength at the operating frequency.

8. The antenna of claim 1 wherein the two feed networks are co-planar, except that one microstrip element from one of the feed networks is bent out of the common plane into an air bridge crossover to avoid touching one of the microstrip elements from the other feed network at a crossing region of said microstrip elements.

* * * * *